United States Patent [19]

Kulkarni

[11] Patent Number: 4,602,991

[45] Date of Patent: Jul. 29, 1986

[54] COAL LIQUEFACTION PROCESS

[76] Inventor: Prabhakar Kulkarni, 12027 Circle Ave., Houston, Tex. 77071

[21] Appl. No.: 542,276

[22] Filed: Oct. 17, 1983

[51] Int. Cl.[4] ..... C10G 1/00; C10G 1/06

[52] U.S. Cl. ..... 208/400; 208/423; 208/425; 585/943

[58] Field of Search ..... 208/8 R, 10

[56] References Cited

U.S. PATENT DOCUMENTS

| | | | |
|---|---|---|---|
| 1,342,790 | 6/1920 | Bergius . | |
| 2,210,117 | 8/1940 | Dreyfus | 260/679 |
| 2,215,206 | 9/1940 | Biggs et al. | 196/53 |
| 2,216,130 | 10/1940 | Pier et al. | 260/668 |
| 2,913,397 | 11/1959 | Murray, Jr. et al. | 208/8 R X |
| 2,991,164 | 7/1961 | Elliot et al. | 48/197 |
| 3,030,297 | 4/1962 | Schroeder | 208/8 |
| 3,823,084 | 7/1974 | Schroeder | 208/10 |
| 3,960,700 | 6/1976 | Rosen et al. | 208/8 R |
| 3,972,958 | 8/1976 | Garwood et al. | 260/683.49 |
| 4,049,734 | 9/1977 | Garwood et al. | 260/668 R |
| 4,052,293 | 10/1977 | Mercer et al. | 208/8 R |
| 4,076,761 | 2/1978 | Chang et al. | 260/668 R |
| 4,077,868 | 3/1978 | Chambers | 208/10 |
| 4,158,637 | 6/1978 | Jones | 208/449 R |
| 4,161,440 | 7/1979 | Brunson | 208/8 R |
| 4,269,692 | 5/1981 | Babu et al. | 208/10 X |
| 4,292,048 | 9/1981 | Wesselhoft et al. | 208/10 X |
| 4,412,908 | 11/1983 | Yamashita et al. | 208/8 R |

FOREIGN PATENT DOCUMENTS

| | | | |
|---|---|---|---|
| 0629791 | 10/1961 | Canada | 208/8 R |
| 0407400 | 3/1934 | United Kingdom | 208/8 R |

*Primary Examiner*—Andrew H. Metz
*Assistant Examiner*—William G. Wright
*Attorney, Agent, or Firm*—Gunn, Lee & Jackson

[57] ABSTRACT

A liquefaction process for coal or lignite is set forth. In the preferred and illustrated embodiment, coal or lignite is ground to a suitable particle size and placed in a reactor vessel. The reactor vessel is located within a pressure vessel. Pressure in the vessel is reduced to about $10^{-2}$ torr.

Heat is applied. One procedure is to convert the carbon (in the coal or lignite) at an elevated temperature (600°-900° F.) in the presence of hydrogen (at pressures as high as 2,000 psi) into a hydrocarbon mix; depressurization avoids making various oxides and nitrides, and also can be optionally carried out in the presence of iron or iron ore in particulate form acting as a catalyst.

15 Claims, 2 Drawing Figures

COAL LIQUEFACTION PROCESS

BACKGROUND OF THE DISCLOSURE

Coal liquefaction is a procedure discussed in the 1980 text *Coal Liquefaction* by Whitehurst and others. Several procedures are set forth which are believed to be representative of the art. The several procedures do not contemplate the procedure which is the subject matter of this disclosure.

This disclosure is directed to a process for coal liquefaction. Briefly, the process herein can be used with coal or lignite. The term "coal" will be used hereinafter to refer to coal or lignite, meaing a material that is rich in carbon. To be sure, there may be other constituents such as water subject to vaporization. There also may be ash content. Certain volatile components may be included and they are typical hydrocarbons which are driven off from the coal as it is heated.

In an earlier text *Chemistry of Coal Utilization* published by John Wiley in 1945, vacuum distillation of coal was discussed at pages 459–467. This method involves vacuum removal of oxygen and nitrogen followed by heating. In our process strict sense, the vacuum step is preliminary to hydrogen pressurization and heating.

This process contemplates the injection of hydrogen gas under pressure for conversion into hydrocarbons. The resultant hydrocarbon that is made is not a single compound but rather it is a spectrum of various hydrocarbons. For instance, the constituents may be in the paraffin series. However, other hydrocarbons can be formed including benzenes and aromatics. The conversion process herein taught has an initial step of grinding the particulate coal to particle sizes suitable to enable ready commingling with the hydrogen gas in a conversion chamber. Coal is introduced into a furnace to be mixed with hydrogen gas. However, an important preliminary step is the more or less total evacuation of atmospheric air from the vessel. In particular, this evacuates nitrogen and oxygen. Thereafter, the temperature is raised. As the temperature is raised and while it is sustained at the peak, various volatile constituents are driven off from coal including combustible hydrocarbons to be recovered. Water may also be driven off as the temperature is raised. More or less simultaneously with hydrogen injection at high pressure, the temperature is raised.

The method of the present invention teaches the use of a vacuum chamber around the reactor vessel. The vacuum chamber initially drops the pressure to a relatively low pressure, typically in the range of $10^{-2}$ torr. This is accomplished before the temperature is raised and before hydrogen is introduced. As the pressure in the vessel is lowered, various gases and vapors are boiled off and they also are removed by operation of the vacuum pump connected with the vacuum or pressure chamber. This continues during the reduced pressure step. The vessel is held at a reduced pressure for a period of time; then, both the hydrogen pressure and temperature are raised from the initial low pressure and room temperature until a final high temperature and pressure are achieved. It has been discovered that the final temperature should be in the vicinity of about 900° F. and final pressure in the range of 1,000–2,000 psi.

Typically, hydrogen is introduced at a pressure steadily raised to about 2,000 psi. While this would ordinarily be a dangerous process, there is a preferred procedure of introducing the hydrogen gradually and ultimately raising the pressure to a maximum pressure. Conversion of the elemental carbon into various hydrocarbons is accomplished. After the maximum pressure of perhaps 1,000 to about 2,000 psi is accomplished, an elevated temperature is held for an interval to enable the conversion to complete. Optionally, stirring can be undertaken to enhance the contact of the particulate coal with the gaseous hydrogen. Fortunately, hydrogen in the elemental form is a relatively penetrating gas, and it becomes commingled intimately with the ground coal, thereby accomplishing a fairly rapid conversion of particulate coal into hydrocarbons. The process can be optionally enhanced by the incorporation of iron or iron ore as a catalyst. The use of such a catalyst appears to lower the maximum temperature required. Rather than typically operating at about 900° F., the process can operate successfully at a lower temperaure, perhaps as low as 600° F. at 1,000 psi. After an interval, the surplus hydrogen can be removed by vacuum pump and reclaimed for subsequent use. Some of the hydrocarbons are gaseous and must be separated from the surplus hydrogen. The pressure vessel can then be cooled to enable recovery of the coal, now in the form of liquefied or solid hydrocarbons. At room temperature some of the liquids will solidify into various tar like materials. The process is not specific in conversion, namely, providing a multitude of hydrocarbon compounds with various and sundry melt points and other physical characteristics.

It is believed that the referenced texts and other references in the area of coal liquefaction do not set out a procedure such as that discussed in summary fashion above. The present invention is therefore summarized as including a procedure or method as set forth above. One advantage of this procedure is that the discharge gases from the vessel are substantially captured and converted, yielding a process which is pollution free. To the extent that any volatile gases are liberated and removed during pressure reduction, gases can be converted. Later on, when the vessel is charged with hydrogen at elevated pressure and temperature, the gaseous hydrogen is commingled with the carbon (of the coal) for an interval, and is preferably thereafter removed for storage of surplus hydrogen.

Several advantages of the present procedure will be noted on review of the detailed description set forth below. Briefly, this invention relates primarily to a procedure or process for conversion of coal into liquid hydrocarbons accomplished by a reactor vessel within an evacuated pressure vessel.

BRIEF DESCRIPTION OF THE DRAWING

So that the manner in which the above recited features, advantages and objects of the present invention are attained and can be understood in detail, more particular description of the invention, briefly summarized above, may be had by reference to the embodiments thereof which are illustrated in the appended drawing.

It is to be noted, however, that the appended drawing illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
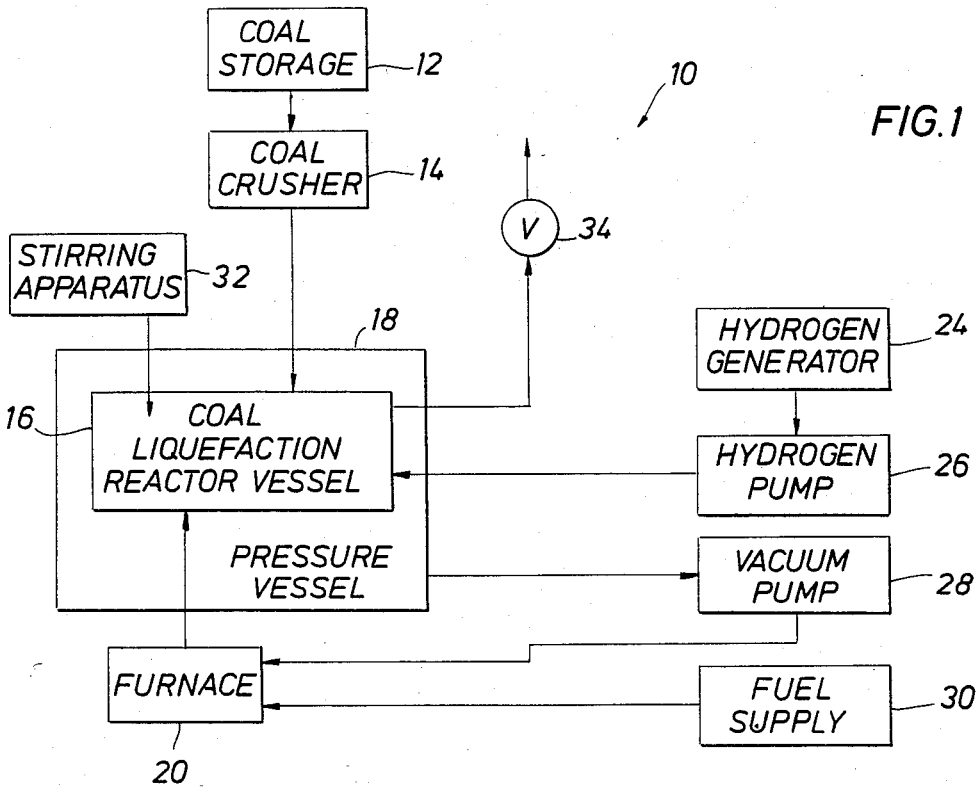
FIG. 1 is a flowchart of the process steps utilized in conversion of coal into liquid hydrocarbons.

Attention is directed to the flowchart (FIG. 1) of this disclosure. The flowchart is identified by the numeral 10. The first step is the step of obtaining a quantity of coal and is indicated at 12. Typically, coal is stored in large mass. The term "coal" generically covers coal and lignite. They are characterized by being rich in elemental carbon. No particular limit is placed on the ash content, volatiles or moisture other than to observe that it is preferable that the ash be a minimum to achieve greater efficiency and reduce ash removal. Also, the volatiles that are present are hopefully the type of volatiles that can be recovered and liquefied later.

Coal in a suitable large quantity is supplied to a coal crusher 14. It is ground to a suitable particle size. The particle size preferably is a range between very small mesh up to larger mesh. For instance, grinding to a size in the range of 4 mesh to about 20 mesh will suffice. Needless to say, grinding improves the speed of conversion. The speed of conversion may be influenced by other factors, and it is practical to utilize reasonably finely ground materials. No particular goal is set for this; rather, the grinding is a preliminary step which assists in the conversion of the coal. In fact, grinding can be omitted if the coal is supplied in broken form.

Attention is next directed to a coal liquefaction reactor vessel 16. It is located inside a pressure vessel 18. A furnace 20 provides heat for the reactor vessel 16. One form of furnace is an induction furance to receive ground coal. The reactor vessel 16 is sized to thereby enable coal to be delivered through some inlet into the reactor vessel. It is also constructed in near proximity to or inside the furnace 20 so that heat can be delivered to it for heating the charge in the reactor vessel.

The reactor vessel is located inside a pressure vessel. The pressure vessel 18 is a closed housing. The reactor vessel is in communication with the surrounding pressure vessel so that pressure within the reactor vessel is reduced. Thus, the charge of coal is exposed to reduced pressure, driving off water and volatile constituents to be collected. The air and vapors are pulled by vacuum pump and transferred out of the pressure vessel in a manner to be described.

The numeral 24 identifies a hydrogen generator. Alternately, a storage container of gaseous or liquid hydrogen can be used. The hydrogen is delivered to a hydrogen pump 26. In turn, the hydrogen pump delivers hydrogen to the reactor vessel. The reactor vessel is evacuated in a controlled fashion by means of a vacuum pump 28. The vacuum pump 28 removes gas from the pressure vessel. The pump 28 discharges through the furnace 20 so that volatiles recovered can be combusted. A fuel supply 30 is also connected to the furnace to furnish fuel so that the requisite temperature can be obtained. The preferred fuel is electric power applied to an induction furnace. A stirring apparatus 32 is included. The vessel 16 forms an output of gaseous hydrocarbons through a valve 34 to an outlet line.

The procedure of the present disclosure involves the following steps. First of all, coal of a suitable composition is crushed in the coal crusher on being supplied from the coal storage facility. The crushed coal is broken to a particular size range. It is then delivered in batch fashion to the reactor vessel 16. It is placed in the reactor vessel. Optionally, the reactor vessel can be stirred during processing. To this end, a stirring apparatus 32 is incorporated in the flowchart, it being understood that it involves stirring the particulate coal in the reactor vessel. The first step in the operation is therefore crushing coal and placing it in the reactor vessel. The next step is to close the pressure vessel 18 and initiate operation of the vacuum pump 28. First of all, atmospheric nitrogen is removed to thereby reduce the risk of formation of oxides of nitrogen. Also, oxygen is removed to reduce the risk of explosion. The pressure in the pressure vessel 18 is reduced to a requisite level of perhaps $10^{-2}$ torr. The range of pressure can be varied; a preferred pressure range is approximately $10^{-1}$ to about $10^{-4}$ torr. Greater vacuum levels can be used but they are not beneficial. In other words, there is no particular benefit by removing even more of the air in the pressure vessel 18. As the air is removed, certain portions of the water and volatiles in the coal will be liberated; they are drawn off relatively easily at low temperatures. The coal may have a modest measure of methane ($CH_4$) in it. The methane may, to a degree, be pulled out by vacuum, or may stay in the coal. Other gases may evolve during evacuation.

It is desirable that the vacuum be completely accomplished to about $10^{-2}$ torr before the temperature is raised. This significant evacuation preferably removes oxygen and nitrogen from the near vicinity to avoid the later formation of oxides or nitrides. As the vacuum is achieved over a few minutes, the temperature is held steady. There is therefore an interval where the vacuum level is held steady to enable the last vestiges of nitrogen and oxygen to be removed. As the pressure is lowered, various volatiles are vaporized including moisture. The vacuum pump is operated for a continued interval to reduce the pressure. As the pressure is dropped, the rate at which the volatiles and moisture are driven off will vary. Whatever the circumstance, gases are removed and eventually, the minimum pressure is achieved.

The coal may be exposed to this level of vacuum for an interval of a few minutes. As the equipment holds the vacuum, the coal is stirred vigorously, releasing more of the gases. Entrained oxygen and nitrogen are released with stirring.

At this stage, the evacuation step ends. The next step involves both hydrogenation under pressure and heating. Hydrogen is admitted from the pump 26 to increase the pressure; the pressure is continued upwardly to about 1,000–2,000 psi. The increase in pressure is normally done in a few seconds, perhaps a minute or two.

As hydrogen under pressure is admitted, the furnace is now turned on to heat the coal. The pressurization step is normally finished before the heating is finished. Indeed, heating raises the temperature and hence the pressure without admitting more gas. Gas is admitted to raise the pressure to some intermediate pressure (say, 100 psi at 80° F.). Then, as the temperature is raised in the closed vessel, the pressure goes up. Accordingly, heating and hydrogen pressurization both occur jointly, at least for practical applications.

While the heating and pressurization with hydrogen steps may be separate or jointly, both steps preferably occur after pressure reduction. This joint step enables the vacuum equipment to be switched off before the furnace is switched on. This step sequence also enables the hydrogen pump to be delayed in operation until later in the procedure.

The optimum temperature for this heating procedure is about 900° F. The maximum is in the range of about 600° to about 1,300°. This wide range is permissible because there is no specific temperature at which the conversion is initiated. At lower temperatures, the conversion occurs but perhaps at a slower rate or with lesser quantities. At higher temperatures, the conversion of carbon into hydrocarbons may occur more rapidly, but again, it is a matter of degree. Ultimately, the maximum temperature is achieved and held for a while. This temperature is held after evacuation, thereby resulting in substantially total removal of oxygen, nitrogen, and water from the coal before conversion.

At this juncture, the procedure is to introduce hydrogen and raise the pressure. The hydrogen is introduced so that the pressure is raised from the minimum pressure. The minimum pressure in the chamber was in the range of about $10^{-1}$ to about $10^{-4}$ torr. It is not essential to sustain this degree of vacuum. After the air and moisture are removed, hydrogen is introduced, raising the pressure from the partial vacuum level described above eventually to a very elevated pressure.

The final pressure is in the range of abut 1,000 to 2,000 psi. Again, significant conversion can be obtained at less than 1,000 psi. A reduced pressure may require longer time to achieve the conversion.

Hydrogen is introduced until an intermediate level is obtained. The contents of the reactor vessel are eventually brought to both an elevated temperature and pressure. Spontaneous conversion of the commingled hydrogen and carbon into various and sundry hydrocarbons is accomplished over an interval. Maximum pressure and temperature are held for an interval of time, such as five to thirty minutes. After this interval has passed, most hydrogen has converted, enabling excess hydrogen to be drawn off to reduce the pressure to ambient pressure. The hydrogen which is drawn off at the end may carry with it certain vaporized volatiles. Preferably, they are separated to reuse surplus hydrogen. Just as the vessel is relieved of pressure, the vessel is also cooled and the various remaining hydrocarbons are removed. Those that were vaporized may solidify or condense on cooling. Thereafter, the solidified hydrocarbons can be removed from the reactor vessel. Filtration may be required to remove ash and any unconverted coal. Thereafter, the process can be repeated on a batch by batch sequence.

As an option, the procedure may proceed more rapidly at lower temperatures and pressures in the presence of a catalyst. One acceptable catalyst is iron or iron ore. Iron ore is primarily an oxide of iron.

As an example, the addition of about one or two percent by weight of iron ore produces liquefied hydrocarbons more quickly than is accomplished without the catalyst. This assumes a fixed pressure and temperature level.

As can be understood from the foregoing, the process particularly features the utilization of pressure reduction to about $10^{-1}$ up to about $10^{-4}$ torr as a preliminary step for the conversion of the coal. That is, the vacuum is formed before the coal is exposed to elemental hydrogen. This initial step of depressurization avoids unwanted chemical reactions.

Figure 2:
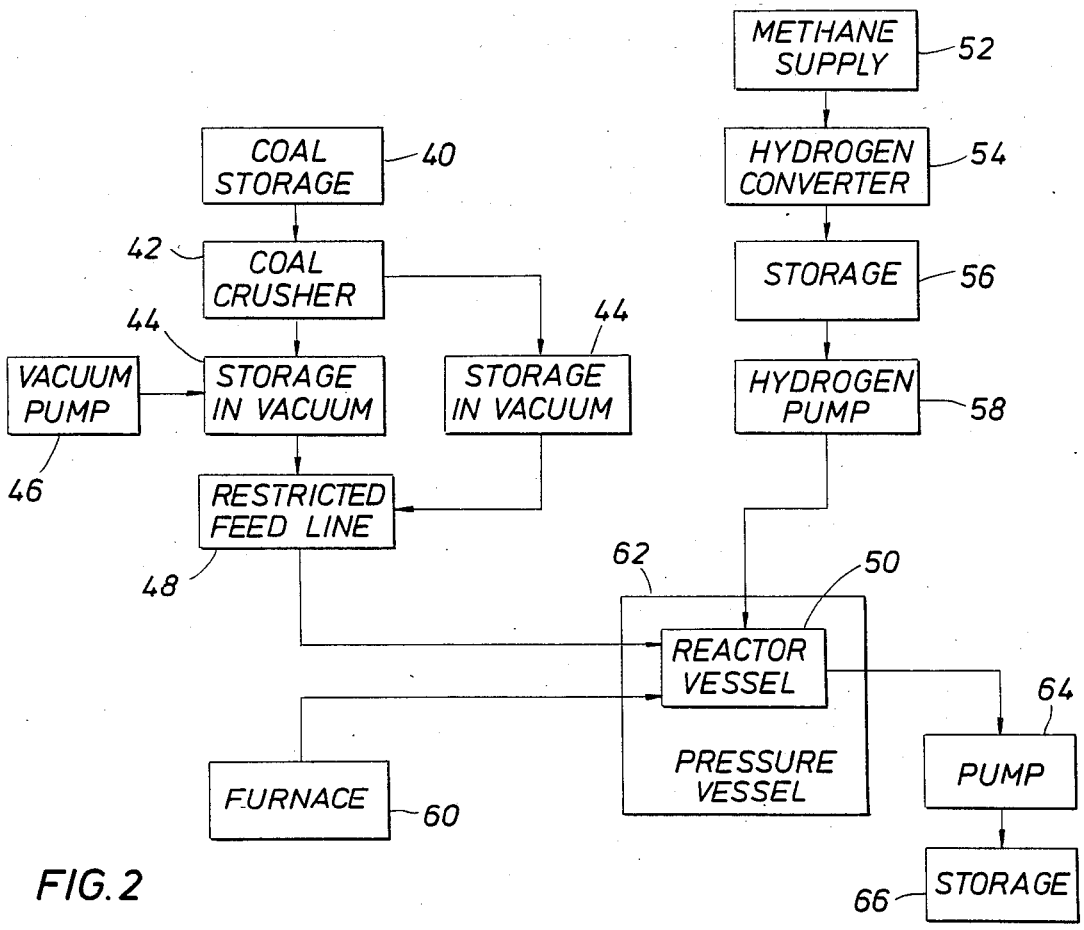
FIG. 2 is an alternate flow chart.

Attention is next directed to the flow chart of FIG. 2 which shows an alternate feed system. This arrangement enables processing of a constant flow as opposed to processing in batch. Constant heating is more efficient and does not require hydrogen removal. In FIG. 2, the numeral 40 identifies a coal storage step. Coal is supplied in the next step to coal crushing step 42. The coal is crushed and pulverized to a suitable range of particle sizes. It is next conducted in a closed and sealed storage container. This step is identified at 44. Alternate containers can be used. The storage container is connected with a vacuum pump. The storage container is preferably filled and packed rather tightly. A continuous flow of coal into the container is supplied. Then, the storage container is sealed. It is provided with a single outlet. In the near vicinity of the outlet, a vacuum pump is connected to evacuate coal in the container. The step of evacuation 46 of the container continues indefinitely. Crushed coal is delivered from the container as illustrated in the flow chart at 48 into a feed line. The feed line is substantially packed with flowing coal. Needless to say, there is an interstical space. This space is ordinarily filled with air but such air is removed. The vacuum removal of air in the storage container is manifest at the restricted feed line. The reduction of pressure at the feed line enables the delivery of a continuous flow of crushed coal in a reduced atmosphere. The reduction is fairly substantial, reaching in the area of $10^{-1}$ or better vacuum. This reduction enables the delivery of crushed coal in a continuous flow into the reactor vessel, this being step 50.

The flow chart of FIG. 2 further includes the additional steps of obtaining a supply of methane gas as indicated at 52. This gas is supplied to a hydrogen converter 54 to form a flow of pure hydrogen. Another alternate procedure is to utilize a supply of compressed hydrogen gas or liquid hydrogen. Hydrogen is delivered to a storage facility 56. It is drawn from the storage facility 56 and pressurized by pumping procedure as indicated at 58.

A furnace 60 provides heat for the reactor vessel 50. Alternate techniques of heating can be used. The preferred furnace is an induction furnace. In any event, a continuous feed of particulate coal is delivered in a substantial vacuum flow through the restricted feed line. The feed line is restricted to enable the delivery of coal through it which flows at a substantial rate with a minimum of interstical space and hence with a minimum of air actually, no appreciable air carried along. This limits flow line involvement in the process. The reactor vessel 50 is secured within a pressure vessel 62. Hydrogen is delivered at a specified pressure. Coupled with the hydrogen and elevated temperature, the reaction in the reactor vessel is carried forward at about the same temperature as previously discussed. That is, the pressure is maintained in the vicinity of about 1,000–2,000 psi. The temperature is raised up to about 1,000°. About 900° is optimum. Lower temperatures in the range of 600° are acceptable but react more slowly. At this pressure and temperature, a continuous flow of vaporous hydrocarbons is removed by pumping. This step is shown in the flow chart at 64, and delivers a flow of mixed hydrocarbons to a storage facility 66. There, they are permitted to cool, and some condensation or solidification may occur.

Primarily, the flow chart of FIG. 2 differs from FIG. 1 because it is more aptly intended to operate in a continuous fashion. That is, material is continuously removed by the pump 64. In actuality, the pressures and temperatures in the vessel 50 are sufficiently high that the pumping step can be dispensed with and a pressure operated check valve can be substituted. That is, when the pressure exceeds a particular pressure, the valve will open to exhaust the hydrocarbons formed in the vessel 50. In like fashion, scheduled flow of crushed coal is delivered. One technique of delivery which enables continuous reaction in the vessel 50 is the procedure of delivering coal into the storage chamber 44 and thereafter closing off the storage chamber 44 from connection with the coal crusher 42. This enables the vacuum pump to evacuate air in the storage chamber. If this approach is used, alternate storage chambers can be used. While they may be alternated, they can be selectively connected to the restricted feed line for delivering a continuous flow of crushed coal without air. There is a smoothing effect to the flow in this case. In this event, the reactor vessel may have hydrogen and coal introduced at one end of a long vessel, and hydrocarbons are pressure vented from the opposite end, assuring adequate retention time.

The foregoing is directed to the methods of the present disclosure. The preferred steps in the method are set forth including optimum pressures, temperatures and cure times.

While the foregoing set forth the preferred embodiment, the scope is determined by the claims which follow.

What is claimed is:

1. A method of converting carbon in the form of coal into a liquefied hydrocarbon comprising the steps of:

(a) charging a coal liquefication vessel with coal to be converted;

(b) reducing the pressure around the coal to a vacuum of at least $10^{-1}$ torr to remove air from the vessel;

(c) raising the temperature of the vessel to heat the coal to a desired temperature;

(d) supplying hydrogen under pressure during the step of raising the temperature to combine in the vessel with carbon in the coal to form hydrocarbon molecules; and (e) removing hydrocarbons from the vessel after combination.

2. The method of claim 1 wherein the coal placed in the reactor vessel is ground to a particle size in the range of about 4 to about 20 mesh.

3. The method of claim 1 wherein the method is practiced on individual coal batches, each batch being processed in the vessel.

4. The method of claim 3 wherein the batches are consecutively placed in a reactor vessel up to a maximum size therefore, and each is processed.

5. The method of claim 1 wherein the step of reducing the pressure occurs in the reactor vessel and is finished before elevating the temperature of the vessel.

6. The method of claim 1 wherein the step of reducing the pressure occurs in the vessel to reduce the pressure to $10^{-1}$ torr or less prior to raising the temperature in the vessel above the ambient temperature.

7. The method of claim 1 wherein the step of elevating the temperature in the vessel proceeds until the temperature exceeds 600° F., and this temperature is sustained for at least several minutes.

8. The method of claim 1 wherein the hydrogen is supplied in the vessel at a pressure of at least 1,000 psi.

9. The method of claim 1 wherein the hydrogen supplied to the vessel at a maximum pressure of about 2,000 psi is sustained as the carbon in the reactor vessel is converted, and thereafter the pressure is reduced to ambient pressure.

10. The method of claim 1 wherein the pressure in the vessel is first fully reduced prior to elevating the temperature; and further including the step of holding the pressure reduced to remove entrained oxygen and nitrogen; and thereafter raising the pressure in the reactor vessel while supplying hydrogen in gaseous form to about 2,000 psi.

11. The method of claim 1 wherein a preliminary step of crushing coal is carried out, the coal being stored in first and second alternate sealed storage containers, and including the step of evacuating air around the coal in one of the containers to the specified vacuum and delivering coal from that container into the coal liquefaction vessel, and thereafter delivering coal from the other vessel into the coal liquefaction vessel.

12. The method of claim 11 wherein crushed coal is delivered alternately from the two storage vessels in a continuous flow into a reactor vessel, and wherein the step of supplying hydrogen under pressure is continuous to sustain a particular pressure range within the reactor vessel, and the step of removing hydrocarbons from the vessel is continuous so long as the reactor vessel is maintained at or above a specified temperature and specified pressure.

13. The method of claim 1 including the step of cooling the recovered hydrocarbons removed from the vessel to a liquid or solid, and also including the step of filtering ash and particulate coal from the recovered hydrocarbons.

14. The method of claim 1 including the step of reducing the pressure around the coal to a vacuum of $10^{-2}$ torr wherein the step liberates volatiles from the coal and such volatiles include hydrocarbons entrained in the coal prior to conversion, and including the step of recovering a spectra of hydrocarbons from the coal after combination.

15. The method of claim 1 including the step of placing a first coal charge in a vessel and a second coal charge after the temperature has been raised, all coal being supplied after pressure reduction to remove air from the coal.

* * * * *